United States Patent [19]

Garrick

[11] Patent Number: 4,828,144

[45] Date of Patent: May 9, 1989

[54] DISPENSER FOR PERMANENT WAVE RODS AND END PAPERS

[76] Inventor: Clayton G. Garrick, 15745 Upper 193rd St. E., Hastings, Minn. 55033

[21] Appl. No.: 182,942

[22] Filed: Apr. 18, 1988

[51] Int. Cl.[4] ..... F42B 39/02; B65D 65/00

[52] U.S. Cl. ..... 221/309; 312/45; 312/72; 221/279

[58] Field of Search ..... 221/34, 307, 309, 310, 221/97, 279; 271/59.2; 372/45, 72, 73

[56] References Cited

U.S. PATENT DOCUMENTS

| | | | |
|---|---|---|---|
| 3,122,270 | 2/1964 | Meng et al. | 221/309 |
| 3,219,244 | 11/1965 | Blask | 221/309 |
| 3,477,774 | 11/1969 | Atwood | 312/73 X |
| 3,626,150 | 12/1971 | Kress | 312/45 X |
| 3,744,673 | 7/1973 | Laitmann | 312/72 |
| 3,957,174 | 5/1976 | Palamara | 221/309 X |
| 4,015,885 | 4/1977 | Baggaley | 312/45 |

*Primary Examiner*—Andres Kashnikow
*Assistant Examiner*—Matthew C. Graham
*Attorney, Agent, or Firm*—Merchant, Gould, Smith, Edell, Welter & Schmidt

[57] ABSTRACT

A dispenser (10) for permanent wave rods (40) and end papers (51) from a box (50) of end papers is disclosed. The dispenser (10) includes a housing (11) and a retainer (20) for holding a plurality of rods (40). The rods (40) may be easily inserted an removed from the retainer (20) and the rod holder (25). The housing (11) is adapted to receive the retainer (20). The box (50) of end papers (51) is releasably held to the housing (11). Further, the dispenser (10) is releasably secured to the user of the dispenser (10).

9 Claims, 3 Drawing Sheets

FIG. 1
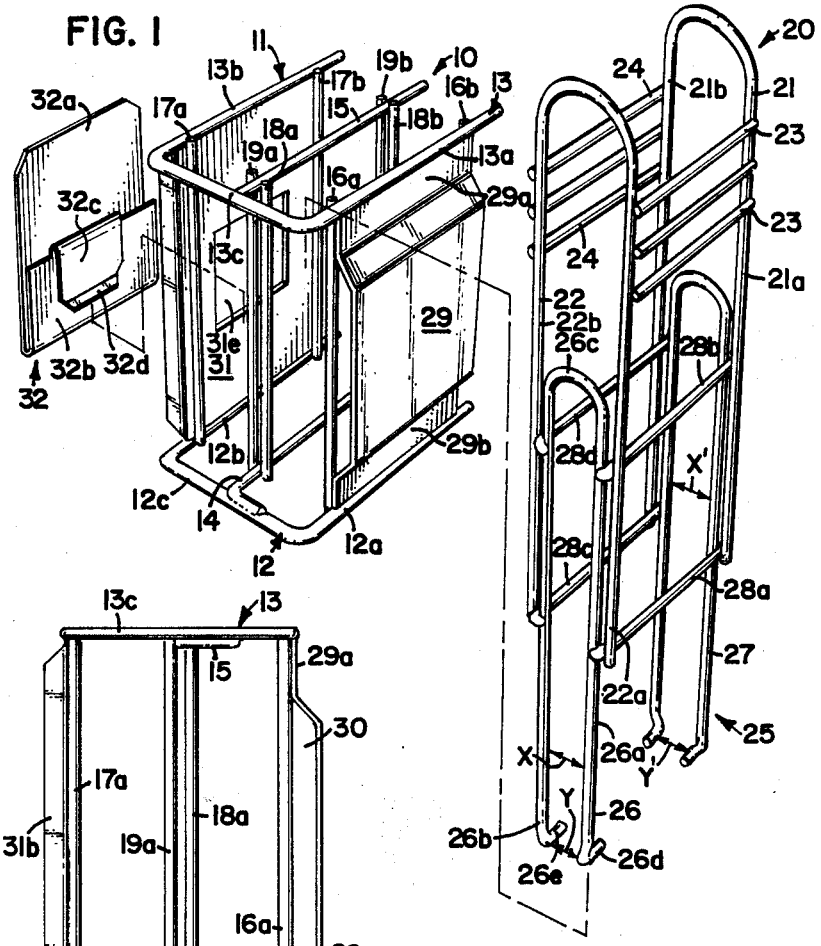
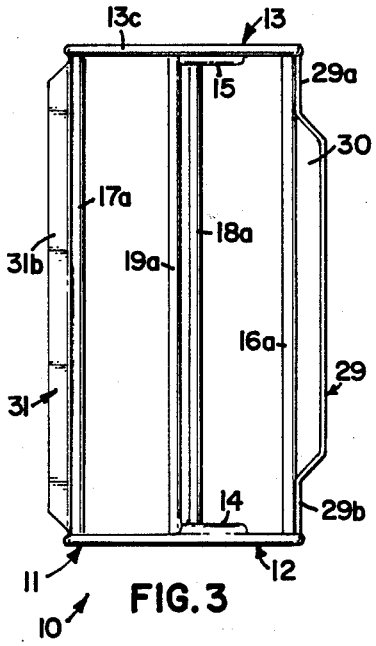
FIG. 3
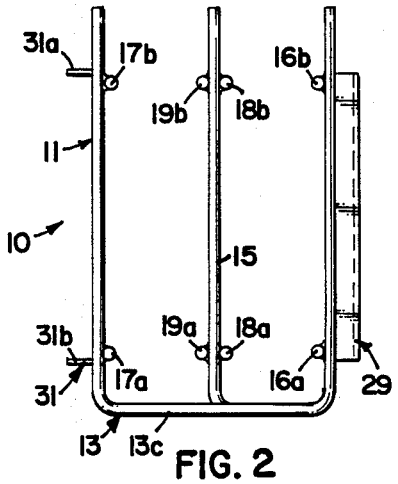
FIG. 2

FIG. 4
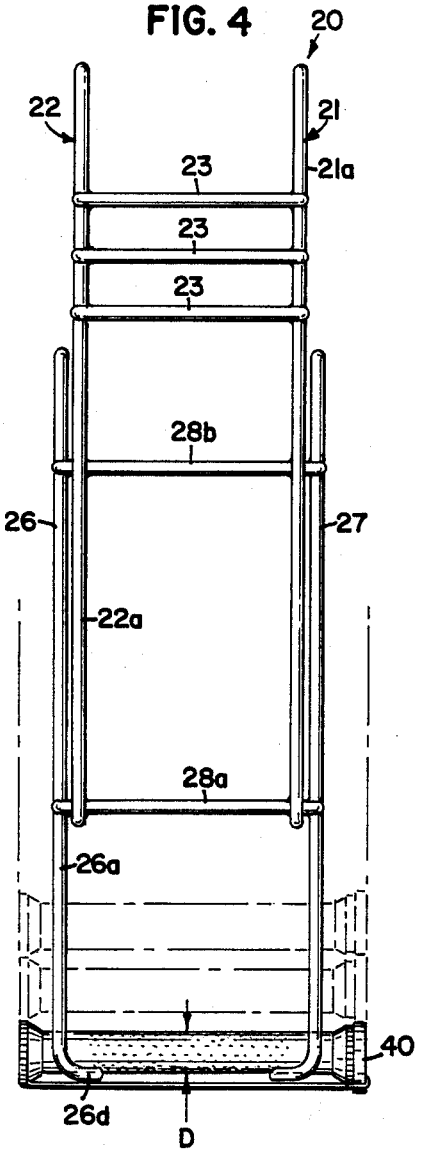
FIG. 5
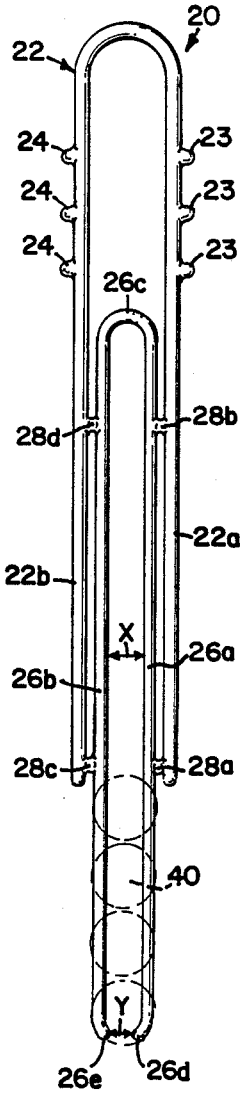
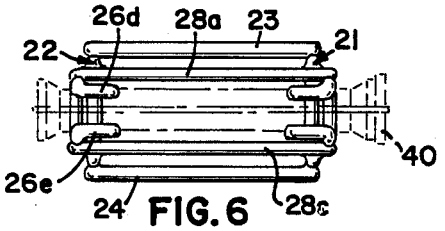
FIG. 6

DISPENSER FOR PERMANENT WAVE RODS AND END PAPERS

BACKGROUND OF THE INVENTION

1. Field of the Invention

This invention relates generally to giving permanents and more particularly relates to an improved dispenser for holding permanent wave rods and end papers which is carried on the body of the user.

2. Description of the Prior Art

By their very nature, permanents are time consuming procedures. Recent developments have vastly improved curl control and processing time, but the stylist's involvement in wrapping time has seen few advances. It is very difficult for the stylist to develop speed in wrapping for many reasons. This includes tangled rods, mixed sizes of rods, reaching and looking for the correct size of rods and reaching and separating end papers. Previously, most stylists had a tray containing a variety of rods and a separate end paper box. The stylist would reach back to obtain the correct rod then reach and find the end paper and finally would wrap the hair.

The tray and end papers are often put on the counter, a considerable or inconvenient distance from the stylist. Some of the stylists use caddies and trays, but the cost of a caddy is quite substantial and still requires the reaching by the stylist each time a rod and end paper was needed.

The present invention addresses the problems associated with the prior art and provides for a unique organizer that keeps the rods and end papers close at hand, by being releasably secured to the stylist, allowing for efficient, smooth and fast wrapping.

SUMMARY OF THE INVENTION

The invention includes a dispenser for permanent wave rods and end papers from a box of end papers having a housing and a retainer for holding a plurality of rods. The rods may easily be inserted and removed from the retainer. Also provided is a means for receiving the retainer. The receiving means is cooperatively connected to the housing. A means for releasably holding of box of end papers is also included. Further, a means for releasably securing the dispenser to a user of the dispenser is included and is cooperatively connected to the housing.

BRIEF DESCRIPTION OF THE DRAWINGS

FIG. 1 is an exploded perspective view of the dispenser incorporating my present invention.

FIG. 2 is an end view of the housing of the dispenser shown in FIG. 1.

FIG. 3 is a side view of the housing shown in FIG. 2.

FIG. 4 is front view of the retainer of the dispenser shown in FIG. 1 showing rods in the retainer.

FIG. 5 is a side elevational view of the retainer of FIG. 4.

FIG. 6 is an end view of the retainer of FIG. 4.

DETAILED DESCRIPTION OF THE PREFERRED EMBODIMENT

Figure 7:
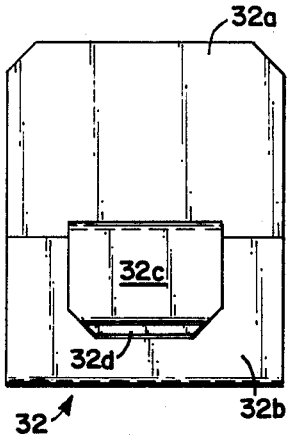
FIG. 7 is a front view of the clip of the dispenser of FIG. 1.

Referring to the drawings, wherein like numerals represent like parts throughout the several views, there is generally designated at 10 a dispenser. The dispenser 10 includes a housing 11. The housing 11 has a bottom U-shaped member 12 and a top U-shaped member 13. The bottom U-shaped member 12 has a first extension **12*a* cooperatively connected to a second extension 12*b* by means of a joining member 12*c*. The top U-shaped member 13 has a first extension 13*a* cooperatively connected to a second extension 13*b* by means of a joining member 13*c*. A bottom middle member 14 is cooperatively connected to the bottom U-shaped member 12 and extends generally outward toward the open end of the U-shaped member 12. Similarly, a top middle member 15 is cooperatively connected to the top U-shaped member 13 and extends generally toward the open end of the top U-shaped member 13. A plurality of sets of guide rods are cooperatively connected between the top U-shaped member 13 and the bottom U-shaped member 12. A first set of guide rods 16*a* and *b* are cooperatively connected at one end to the first extension 12*a* and at their other ends to the first extension 13*a*. A second set of guide rods 17*a* and 17*b* are cooperatively connected at one end to the second extension 12*b* and at their other end to the second extension 13*b*. A third set of guide rods 18*a* and 18*b* are cooperatively connected at one end to the top middle member 15 and at their other end to the bottom middle member 14. The guide rods 18*a* and *b* are positioned on the side of the middle members 14 and 15 which is proximate to the first extensions 12*a*, and 12*b*. The fourth set of guide rods 19*a* and 19*b* are cooperatively connected at one end to the top middle member 15 and at their other end to the bottom middle member 14. The guide rods 19*a* and 19*b* are connected to the middle members 14 and 15 on the side proximate the second extensions 12*b* and 13*b*. Guide rods 16*a*, 17*a*, 18*a* and 19*a* are generally parallel to each other. Similarly, guide rods 16*b*, 17*b*, 18*b* and 19*b*** are generally parallel to each other.

A retainer is generally designated at 20. The retainer 20 includes a first handle member 21 spaced from and cooperatively connected to a second handle member 22. The handle members 21 and 22 are in the general shape of an elongated U. The first handle member 21 has a first section **21*a* cooperatively connected to a second section 21*b* by means of a curved connecting section 21*c*. The first and second sections are generally parallel to each other. Similarly, the second handle member 22 has a first section 22*a* cooperatively connected to a second section 22*b* by means of a curved connecting section 22*c*. Again, the first and second sections 22*a* and *b* are generally parallel. A plurality of support members 23 are cooperatively connected across the retainer and cooperatively connected to the first section 21*a* and the second section 21*b*. Similarly, support members 24 are cooperatively connected across the second sections 21*b* and 22*b***.

A rod holder 25 has a first retaining member 26 spaced from and cooperatively connected to a second retaining member 27. The first retaining member 26 has a first side section **26*a* cooperatively connected to a second side section 26 by means of a top curved section 26*c*. The bottom of the first side section 26*a* has an inwardly protruding end 26*d* and the second side section 26*b* has an inwardly protruding end 26*e*. The distance X between the first side section 26*a* and second side section 26*b* is relatively uniform except toward the bottom of the retaining member wherein the sections are slightly closer together. The distance X′ between the second side section 27***a* and the second side section 27*b* is relatively uniform except toward the bottom of the retaining member wherein the sections are slightly closer. This closer distance is represented by Y and Y'. As will be more fully discussed hereinafter, the diameter "D" of the rod 40 is equal to or slightly greater than the distances X and X'. The distances X and X' being the same and the distance Y and Y' are the same. The lesser distances Y and Y' are less than the diameter of the rod 40, thereby retaining the rod 40 from falling out of the rod holder 25.

Supports 28*b, c, d* and *e* are cooperatively connected between the first retaining member and second retaining member 27 to form the rod holder 25. The support members 28*a* through *d* are also cooperatively connected to the first handle member 21 and second handle member 22 so that the rod holder is carried by the handle members 21 and 22.

Preferably, the handle members 21 and 22, retaining members 26 and 27 and top and bottom U-shaped members 12 and 13 are each a single rod. While all of the members discussed to date are shown in the figures as having a circular cross-section, it is also understood that other configurations may also be used. The members described previously are preferably metal rods which are cooperatively connected to each other by means of welding or other suitable methods well-known in the art. Further, it is preferred that the rods be dip coated with a plastic material to form an aesthetically pleasing appearance. A belt fastening member 29 has a first end 29*a* cooperatively connected to guide rods 16*a* and 16*b* proximate the top U-shaped member 13 and a second end 29*b* cooperatively connected to the guide rods 16*a* and *b* proximate the bottom U-shaped member 12. A center section 29*c* protrudes outward from the first and second ends 29*a* and 29*b* so that a gap 30 is formed between the belt retaining member 29 and the guide rods 16*a* and 16*b*. The retaining member 29 is preferably of metal which has been welded to the guide rods 16*a* and *b* and also coated with a plastic material.

Figure 8:
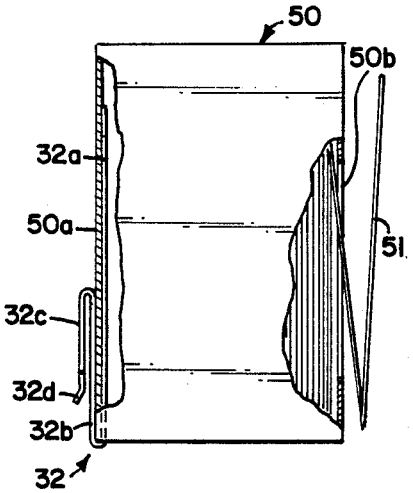
FIG. 8 is a side view of the clip of FIG. 7 showing a box of end papers attached thereto.

A plate 31 is cooperatively connected between the top U-shaped member 13 and bottom U-shaped member 12. The plate 31 may have outwardly extending side flanges 31*a* and 31*b* which, as will be described more fully hereinafter, form a guide for the box of end papers. Preferably, the flanges and plate are all formed as a one-piece unit. The plate has a centerly located opening 31*c*. The opening 31*c* is used for operatively engaging a clip 32. The clip 32, as fully shown in FIGS. 1, 7 and 8, is preferably formed from a single sheet of metal and bent to form the configuration as shown in the drawings. The clip 32 has a back member 32*a* cooperatively connected to and slightly spaced away from the front member 32*b*. A downwardly depending engaging member 32*c* is cooperatively connected to and slightly spaced away from the front member 32*b*. The engaging member 32*c* has a outwardly extending flange 32*d*. The width of the front member 32*c* is less than the width of the opening 31*c*. The clip 32 is releasably and cooperatively connected to the plate 31 by simply inserting the plate 31 between the front member 32*b* and engaging member 32*c*. The outwardly extending flange 32*d* assists in the engagement of the plate 31. The dispenser 10 is utilized for the dispensing of end papers 51 which typically come in a cardboard box 50. The box 50 gas a back wall 50*a* which is inserted into the clip 32 between the back member 32*a* and front member 32*b*. The papers 51 are then able to be dispensed through an opening 50*b* which is formed in the front of the box 50.

In operation, the user of the dispenser 10 decides on what side the user wishes to wear the dispenser 10. It has been found that it is most advantageous to wear the dispenser 10 on the side of the wearer and further that the sections 12*c* and 13*c* be facing forward. The dispenser 10 is versatile in that it may be worn on either side of the wearing. The wearer simply has to rotate the dispenser 180° for use on the other side. To secure the dispenser 10 to the wearer, it is only necessary that a belt of the wearer be inserted through the gap 30 and the belt then tightened around the waist of the wearer. The rod holder 25 is first loaded with a plurality of rods 40. Prior to insertion of the rods 40 into the rod holder 25, the rods are cleaned. To insert the rods 40 into the rod holder 25, it is only necessary to place the rod holder 25 over the rod 40 and then press down on the rod 40. The distances Y and Y' are less than the diameter of the rod 40. Therefore it is necessary that the distances Y and Y' be increased by deformation as the rods are on pushed onto the rod holder 25. By pressing down on the rod 40, the first retaining member 26 and second retaining member 27 are deformed and the distance Y and Y' is increased to allow for the rod to be inserted into the rod holder 25. Since the distances X and X' are greater than the diameter of the rod 40, the rod is then gradually pushed up into the rod holder 25 as subsequent rod 40 are inserted into the bottom of the rod holder. While the rod holder 25 may be sized to accommodate a varying number of rods, it has been found that 12 to 16 rods is the preferred number of rods to be inserted into the rod holder 25. With more rods than this, tangling of the bands, which are attached to the rods, may occur.

When it is necessary to use more than one size rod for giving a permanent, the dispenser 10 can easily handle this requirement. The rod holder 25 is easily modified to accept different sized rods. It is a simple matter of having the retaining members 26 and 27 be spaced slightly farther apart and have the distances X and X' increased to accommodate a larger sized rod. Further, as shown in the Figures, the retaining members 26 and 27 are spaced such that the retaining members 26 and 27 are between the guide rods 17*a* and 17*b*. However, if larger sized rods were to used, the retaining members 26 and 27 are spaced farther apart and they would then be outside of the guide rods 17*a* and 17*b* when inserted.

Once the rod holder 25 is loaded with rods, the user grasps the retainer 20 at the U-shaped ends and inserts the rod holder 25 into the dispenser 10. The two sets of guide rods 17*a* and 17*b* and 19*a* and 19*b* form one slot for the rod holder 25 and the other guide rods 18*a* and 18*b* and 16*a* and 16*b* form another slot for a second rod holder 25. In more detail, the first section 21*a* would slide just inside of the guide rod 19*b*, the first section 22*a* would slide just inside of the guide rod 19*a*, the second section 21*b* would slide just inside of the guide rod 17*b* and the second section 22*b* would slide just inside of the guide rod 17*a*. The entire retainer assembly 20 is stopped from going complete through the slot formed between the guide rods by the support members 23 and 24 coming in contact with the top 15 and second extension 13*b* respectively. The distance between the top 15 and the second extension 13*b*, which forms the width of the slot for the retainer 20, is sized to accommodate the retainer 20. However, if it is necessary that the slot be slightly increased in width, the dispenser is easily deformed at its open end of the U-shaped members. A second rod holder 20 is then inserted into the other slot formed by the guide rods 16*a* and 16*b*, guide rods 8 and 18*b* and the top 15 and first extension 13*a*. This rod holder may or may not have different sized rods than the previous holder 25. This would be dependent upon the type of permanent the user is planning on giving.

The clip 32 is then positioned onto the dispenser 10 by simple insertion into the opening 31*c*. The plate 31 is positioned between the front 32*b* and the engaging member 32*c* and thereby becomes releasably connected to the dispenser 10. Depending upon the orientation of the dispenser 10 on the user, the clip may be inserted into either the top or the bottom of the opening 31*c*. Once the clip 32 is in position, the user then takes a box 50 of containing end papers 51 and places it onto the back member 32*a*. This is accomplished by inserting the back wall 50*a* of the box 50 between the back member 32*a* and the front member 32*b*, as shown in FIG. 8. End papers 51 may then be easily dispensed from the opening 50*b* formed in the box 50. Similarly, rods may now be easily dispensed through the bottom of the rod holder 25.

The user is now in a position to give a permanent without having tangled rods and mixed sized rods in a box. Further, there is no reaching and hunting for the correct rod sizes and there is no reaching and separating of end papers. The rods and the end paper which the user needs are literally at the user's side which results in a more uniform permanent wave in a shorter period of time. The hair does not have a chance to dry out as long because the user is able to wrap the hair more quickly. Further, the amount of reaching and twisting is greatly reduced, thereby reducing possibilities of back injuries.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follow in the spirit and broad scope of the appended claims are included.

I claim:

1. A dispenser for permanent wave rods and end papers from a box of end papers, comprising:

(a) a housing;

(b) a retainer for holding a plurality of the rods, the rods being easily inserted and removed from the retainer;

(c) means for receiving the retainer, said receiving means cooperatively connected to the housing;

(d) means for releasably holding the body of end papers;

(e) means for releasably securing the dispenser to a user of the dispenser, said securing means cooperatively connected to said housing; and (f) said housing and receiving means comprise:

(i) a bottom U-shaped member;

(ii) a top U-shaped member; and (iii) first and second sets of guide rods cooperatively connecting said bottom U-shaped member to said top U-shape member, wherein said retainer is slidable into a slot defined by said guide rods and is supported thereby.

2. The dispenser of claim 1, wherein a distance between said first and second sets of guide rods is less than a width of said retainer to form a friction fit and wherein said open U-shaped members can deform at their open end for said retainer to fit in said slot.

3. The dispenser of claim 1 further comprising a middle member extending from the closed end of the bottom U-shaped member to its open end and a middle member extending from the closed end of the top U-shaped member to its open end and a middle member extending from the closed end of the top U-shaped member and third and fourth sets of guide rods cooperatively connecting said middle members, thereby forming an additional slot to receive an addition retainer.

4. The dispenser of claim 1, wherein said retainer comprises:

(a) a first retainer member spaced from and cooperatively connected to a second retaining member, the rods being insertable into and held between said first retaining member and said second retaining member; and (b) a handle cooperatively connected to said retaining member.

5. The dispenser of claim 4, wherein said first retaining member comprises:

(a) first rod spaced from and cooperatively connected to a second rod to form a slot for receiving one end of the rods; and (b) said slot having a lesser width at its receiving end than the diameter of the rods and said lesser width being able to expand to a greater width to allow for insertion of the rods.

6. The dispenser of claim 1, wherein said releasable securing means comprises:

(a) a plate cooperatively connected to said top and bottom U-shaped members; and (b) said plate extending outward between said U-shaped members to allow for insertion of a belt or similar device worn by a user.

7. The dispenser of claim 1 wherein said releasable holding means comprises:

(a) a section member cooperatively connected to said top and bottom U-shaped member and having an aperture formed therein; and (b) a clip having a means to secure the clip to said aperture and a flange extending outside of said section member, whereby a box of end papers may be slipped over said flange and thereby be secured.

8. The dispenser of claim 7, wherein said clip is reversible so that said flange extends outside of said section member in either of two directions 180° apart.

9. A dispenser for permanent wave rods and end papers from a box of end papers, comprising:

(a) a housing;

(b) a retainer for holding a plurality of the rods, the rods being easily inserted and removed from the retainer, said retainer comprising:

(i) a first retaining member spaced from and cooperatively connected to a second retaining member, the rods being insertable into and held between said first retaining member and said second retaining member;

(ii) a handle cooperatively connected to said retaining member;

(c) means for receiving the retainer, said receiving means cooperatively connected to the housing;

(d) said housing and receiving means comprise:

(i) a bottom U-shaped member;

(ii) a top U-shaped member; and (iii) first and second sets of guide rods cooperatively connecting said bottom U-shaped member to said top U-shaped member, wherein said retainer is slidable into a slot defined by said guide rods and is supported thereby, wherein a distance between said first and second sets of guide rods is less than a width of said retainer to form a friction fit and wherein said open U-shaped members can deform at their open end for said retainer to fit in said slot;

(e) means for releasably holding the box of end papers, said releasable holding means comprising:

(i) a section member cooperatively connected to said top and bottom U-shaped member and having an aperture formed therein;

(ii) a clip having a means to secure the clip to said aperture and a flange extending outside of said section member, whereby a box of end papers may be slipped over said flange and thereby be secured and wherein said clip is reversible so that said flange extends outside of said section member in either of two directions 180° apart; and (f) means for releasably securing the dispenser to a user of the dispenser, said securing means cooperatively connected to said housing, said means comprising:

(i) a plate cooperatively connected to said top and bottom U-shaped members;

(ii) said plate extending outward between said U-shaped members to allow for insertion of a belt or similar device worn by a user.

* * * * *

UNITED STATES PATENT AND TRADEMARK OFFICE

CERTIFICATE OF CORRECTION

PATENT NO. : 4,828,144

DATED : May 9, 1989

INVENTOR(S) : Clayton G. Garrick

It is certified that error appears in the above-identified patent and that said Letters Patent is hereby corrected as shown below:

In column 5, line 3, delete "8" and substitute therefore --18--.

In column 5, line 54, delete "body" and substitute therefore --box--.

Signed and Sealed this

Twenty-seventh Day of March, 1990

*Attest:*

JEFFREY M. SAMUELS

*Attesting Officer*

*Acting Commissioner of Patents and Trademarks*